United States Patent [19]

Campbell et al.

[11] 4,155,818

[45] May 22, 1979

[54] SEMI-CONTINUOUS ELECTRO-HYDRODIMERIZATION OF ACRYLONITRILE TO ADIPONITRILE WITH REPLATING OF CATHODE

[75] Inventors: Charles R. Campbell; William A. Heckle; Marion J. Mathews, all of Pensacola, Fla.

[73] Assignee: Monsanto Company, St. Louis, Mo.

[21] Appl. No.: 925,012

[22] Filed: Jul. 17, 1978

[51] Int. Cl.[2] ..... C25B 3/10; C25B 11/04; C25B 11/02; C25D 5/34

[52] U.S. Cl. ..... 204/73 A; 204/32 R; 204/50 Y; 204/290 R

[58] Field of Search ..... 204/50 Y, 73 A, 73 R, 204/32 R

[56] References Cited

U.S. PATENT DOCUMENTS

| | | | |
|---|---|---|---|
| 2,848,393 | 8/1958 | Foulke et al. | 204/50 Y |
| 3,616,320 | 10/1971 | Beck et al. | 204/73 A |
| 3,770,596 | 11/1973 | Bick et al. | 204/43 G |
| 3,826,722 | 7/1974 | Accaries et al. | 204/50 R |
| 3,844,911 | 10/1974 | Ruehlen | 204/73 A |
| 3,898,140 | 8/1975 | Lester et al. | 204/73 A |
| 3,960,679 | 6/1976 | Campbell et al. | 204/73 A |
| 4,048,047 | 9/1977 | Beck et al. | 204/270 |

*Primary Examiner*—F. C. Edmundson
*Attorney, Agent, or Firm*—Thomas Y. Awalt, Jr.

[57] ABSTRACT

An improvement in the process of electrohydrodimerizing acrylonitrile to adiponitrile wherein the plated electrodes, which are employed in the process as a part of an electrolytic cell, are, without removal from the cell, cleaned and replated.

13 Claims, 3 Drawing Figures

SEMI-CONTINUOUS ELECTRO-HYDRODIMERIZATION OF ACRYLONITRILE TO ADIPONITRILE WITH REPLATING OF CATHODE

BACKGROUND OF THE INVENTION

1. Field of the Invention

The invention relates to the production of adiponitrile from acrylonitrile by electrochemical synthesis, and particularly to an improvement in such a process wherein the electrodes are cleaned and replated in the electrohydrodimerization cell.

2. Background of the Invention

The reduction of acrylonitrile to adiponitrile by electrohydrodimerization is taught in British Pat. No. 1,089,707 (to Tomilov). In such a reaction, it is often preferred to use cathodic surface metals selected for high hydrogen over-voltage, and although metals such as lead, thallium, zinc, mercury and cadmium are preferred, because of the expense of the material and the lack of strength of these materials, it is common practice to electroplate the desired metal on a more suitable metal such as steel which is strong, readily available and inexpensive. A suitable cathode, for example, for the electrohydrodimerization of acrylonitrile to adiponitrile is cadmium-plated steel.

Electroplating of various metals by any of several methods, including the cyanide or alkaline method, the acid sulfate method, the pyrophosphate method, the fluoborate method and the phytic (hexaphosphoric) acid method, is well known. All are described, for example, in U.S. Pat. No. 2,973,308.

Commercially, electrolytic cells for electrochemical synthesis are constructed of electrodes in permanently fixed and substantial parallel planar relationship. Metal-plated cathodes are typically electroplated from cadmium sacrificial anodes.

In the course of electrohydrodimerization of acrylonitrile to adiponitrile, it is desirable, from time to time to clean and re-electroplate cathodes, and if such re-electroplating could be accomplished without disassembly of the electrode package and/or without removal of the package from the cell, a considerable amount of time and effort could be saved, such an accomplishment being a primary object of this invention.

SUMMARY OF THE INVENTION

This invention is an improvement in the process for the production of adiponitrile from acrylonitrile by electrolytic dimerization in an electrolytic cell having a dimerization electrolyte and electrodes (anodes and cathodes), where at least a portion of the cathodes are metal-plated, and where the cathodes after prolonged exposure to the dimerization electrolyte during the electrolytic dimerization process, require occasional cleaning and electroplating. The improvement comprises (1) draining the cell of the dimerization electrolyte, (2) cleaning the electrodes, (3) replacing the dimerization electrolyte with an electroplating solution containing the plating metal in complex form, (4) applying an electric potential between the anodes and the cathodes whereby the cathodes are electroplated and the anodes function as non-sacrificial anodes, (5) thereafter discontinuing the electric potential without draining the cell thereby permitting the newly electroplated cathodes exposure to the plating solution in the absence of an electric potential for a definable exposure period, (6) thereafter draining the electrolytic cell of the electroplating solution, (7) replacing the electroplating solution with the dimerization electrolyte and (8) continuing the electrolytic dimerization process.

THE DRAWING

In order to better understand the invention reference will be made to the attached drawing in which.

DETAILED DESCRIPTION OF THE INVENTION

Figure 1:
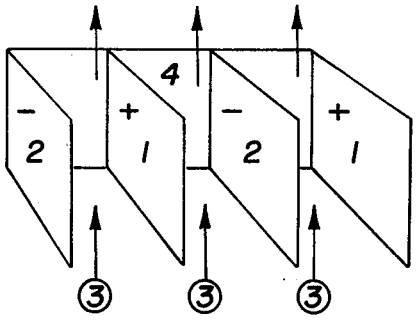
FIG. 1 illustrates diagrammatically in vertical section an arrangement of electrodes for electrochemical synthesis which can be electroplated in accordance with the instant invention.

A description of a typical process for the production of adiponitrile from acrylonitrile, suitable for employment in conjunction with the improvement described herein, is contained in British Pat. No. 1,447,772 (hereby incorporated by reference). The electrolytic cell contains a cadmium-plated carbon steel cathode.

As described above, the improvement of this invention comprises draining the cell of the dimerization electrolyte and then cleaning the electrodes. It has been found that rinsing the cadmium plated electrodes in a phosphoric acid solution will clean the electrodes of most fouling. A preferred phorphoric acid solution for such cleaning is a 50 volume % water and 50 volume % phosphoric acid solution of a concentration of 85%. After washing with a phosphoric acid solution, the electrodes are rinsed with water to complete the cleaning step. It has also been found that the electrodes may be effectively cleaned with an electroplating solution, and this eliminates the need for rinsing before electroplating.

After cleaning, an electroplating solution containing the plating metal in complex form is introduced into the cell.

Where the cathode is to be cadmium plated, cadmium complexing agents as, for example, cyanide (CN-) and ethylenediaminetetraacetate (EDTA) have been found satisfactory. Where EDTA has been employed, a greater variety of levelers, including hexadecyl trimethylammoniumhydroxyde (C16 TMAOH) as well as a polyether surfactant has been found suitable as a leveling agent. As stated above, the only source of the metal to be plated upon the cathode is in the plating solution. The plating solution may be of decreasing concentration of the cadmium complex or the concentration may be fixed by reconstituting the solution on a cycle employing methods well known in the electroplating art.

As is well known in the art, the employment of a reducing agent such as hydrazine minimizes the anodic oxidization of the metal complex agent, as taught in U.S. Pat. No. 3,770,596, (hereby incorporated by reference), and is preferred.

Due to the close relationship of the electrodes in most commercial electrode packages, it is most important that the electroplating be of a smooth and uniform consistency. Accordingly, a leveling agent of the polyether surfactant type is preferably employed. Polyether surfactants operable in the practice of this invention may include aromatic polyethers and aliphatic polyethers. Preferably the surfactant is a polyalkoxylated alkyl phenol. Typical polyalkoxylated alkyl phenols include polyethoxylated alkyl phenols having the formulae:

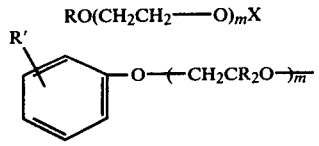

wherein R represents an aryl group of from 5 to 18 carbon atoms, R' is an aliphatic radical containing 8 to 20 carbon atoms, m is an integer of at least 4 and no more than 100, and X is selected from the group consisting of hydrogen, $SO_3M$, and $PO_4M_2$ where M is selected from the group consisting of sodium, potassium, ammonium, magnesium, lead, tin, calcium, rubidium, cesium, or any other bath-compatible cation. Operable polyether surfactants include nitrogen-containing aliphatic polyethers characterized by the following general formulae:

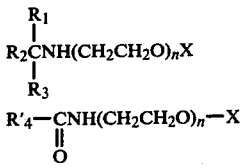

wherein $R_1$, $R_2$, $R_3$ and $R_4$ represent a straight or branched chain alkyl group exhibiting 8 to 18 carbon atoms, n is an integer of at least 4 and no more than 100, and X is selected from the group consisting of hydrogen, $SO_3M$, $PO_4M_2$ where M is selected from the group consisting of sodium, potassium, ammonium, magnesium, lead, tin, calcium, rubidium, cesium, or any other bath-compatible cation. Polyether surfactants are employed singly in amounts of about 1 g./l. to 10 g/l., and in combination from 10 g./l. to 20 g./l. Typical specific compounds are the following with their concentration ranges varying singly from 1 g./l. to 10 g./l. and in combination from 10 g./l. to 20 g./l.:

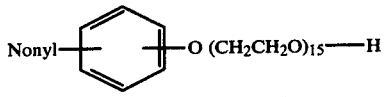

(sold as Tergitol Non-Ionic NP-35)

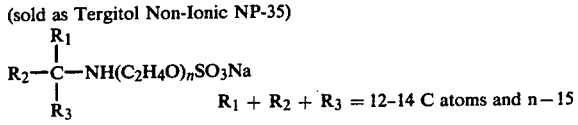

(sold as Triton QS-15)

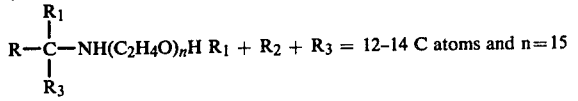

(sold as Priminox R-15)

The substrate of the metal-plated cathode (and the anode surface) preferably consists essentially of carbon steel as opposed as to iron, alloy steel or stainless steel. Carbon steel, as defined herein (and by the American Iron and Steel Institute [AISI]) is as follows: "carbon steel is classed as such when no minimum content is specificed or guaranteed for alumnium, chromium, columbiumn, molybdenum, nickel, titanium, tungsten, vanadium, or zirconium; when the minimum for copper does not exceed 0.40 percent; or when the maximum content specified or guaranteed for any of the following elements does not exceed the percentages noted: maganese 1.65; silicon 0.60, copper 0.60."

After electroplating, if appropriate, the power supply should be discontinued and the used plating solution circulated through the cell for an additional definable exposure period of time before being drained from the cell. By "definable exposure period" is meant any period beyond an instantaneous exposure. A preferred period of exposure is 1-10 minutes. Periods in excess of about 10 minutes serve no useful purpose, and may result in loss of some of the plating. The rinsing of cathodes, particularly cadmium plated cathodes with the electroplating solution has been found to inhibit fouling of the cathode.

Referring to the drawing, FIG. 1 shows an arrangement of substantially parallel planar fixed electrodes which is suitable for semi-continuous electrohydrodimmerization of acrylonitrile to adiponitrile and for electroplating in accordance with the improvement of this invention. The electrodes are anodes (1) and cathodes (2) which are held in fixed parallel planar relationship by non-conductive backing (4). An electroplating solution (3) passes between anodes (1) and cathodes (2).

Figure 2:
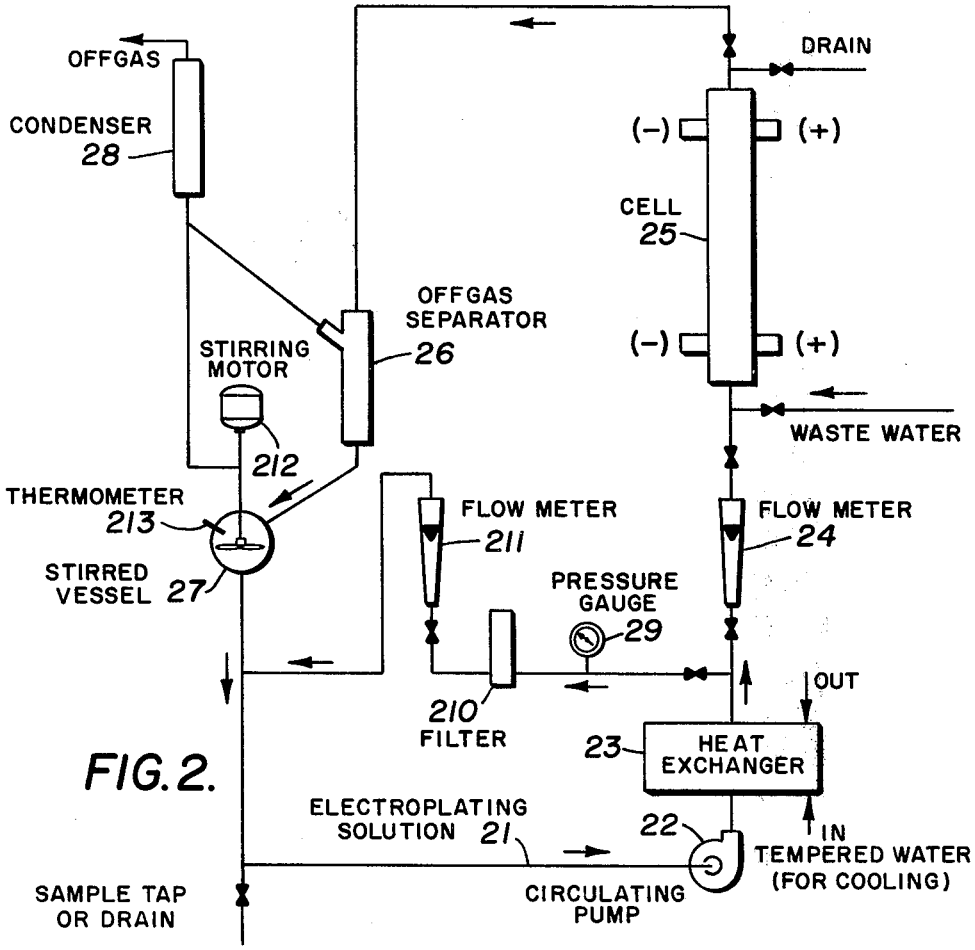
FIG. 2 is a schematic diagram of a cell suitable for electrochemical synthesis showing apparatus for electroplating.

Referring in detail to FIG. 2, electroplating solution (21), containing the cadmium complex, leveling agent and anode depolarizer is pumped by means of circulating pump (22) through heat exchanger (23) and flow meter (24) to cell (25) where electroplating takes place. Passing through cell (25), the solution is pumped to off-gas separator (26) where most of the off-gas is separated from the liquid which drains into stirred vessel (27). The gas itself is passed to condenser (28) for removal of condensable material. Between heat exchanger (23) and flow meter (24) is a filtration stream comprising pressure gauge (29) filter (210) and flow meter (211). Stirring motor (212) and thermometer (213) are included in stirred vessel (27).

Figure 3:
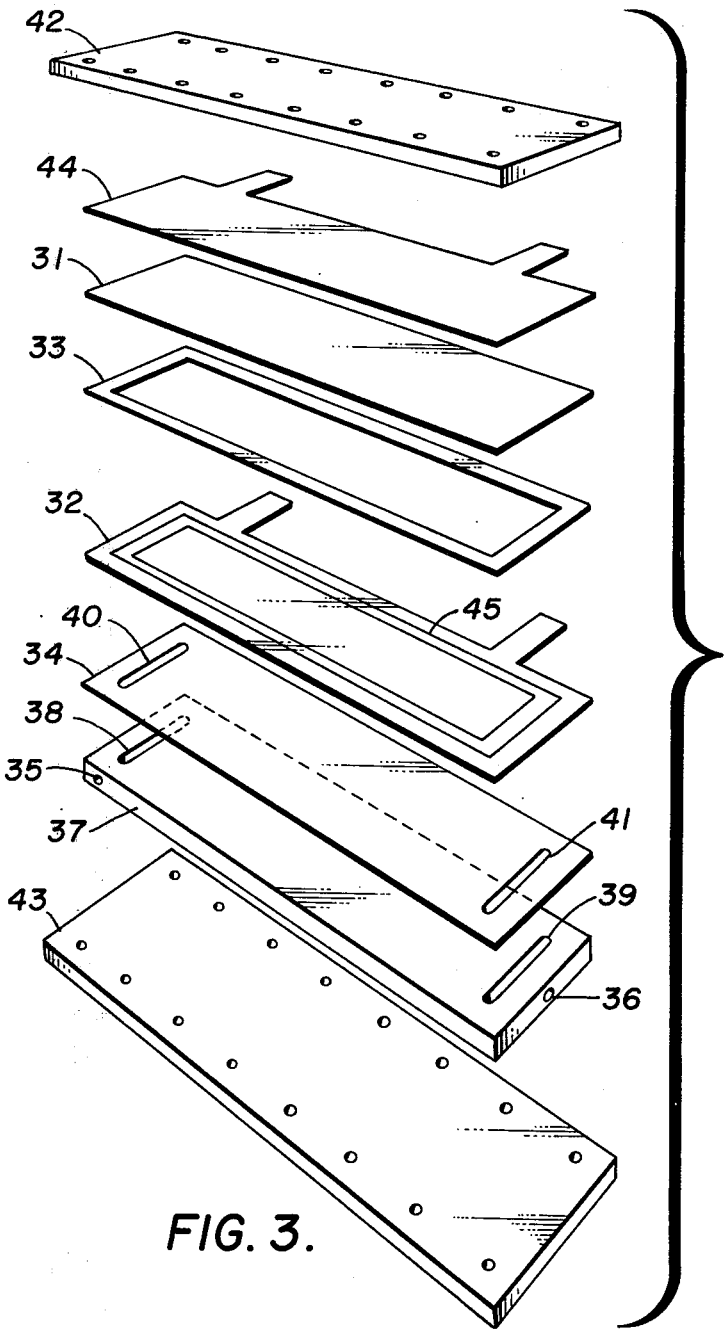
FIG. 3 is an exploded assembly of an experimental electrode package of a type which may be electroplated according to this invention.

Referring in detail to FIG. 3, the essential portions of the simplified cell are cathode (31) and anode (32), which are separated by plastic spacer (45). A circulation chamber is defined by cathode (31), anode (32) and the inside perimeter of plastic spacer (45). The electroplating solution is fed through aperture (36) and slot (39) of polyethylene feed block (37) through slot (41) of neoprene gasket (34) to the aforementioned circulation chamber, and from the circulation chamber through slot (40) of neoprene bottom gasket (34), slot (38) of polyethylene feed block (37), and out through aperture (35) of polyethylene feed block (37), and out through aperture (35) of polyethylene feed block (37). The entire assembly, including plastic upper and lower plates (42) and (43) and conductor plate (44) is assembled in fixed parallel-planar relationship. Plastic spacer (45) on anode (32) assures uniform spacing of the element from cathode (31). Spacer (45), in this particular embodiment is 0.178 cm thick.

Examples 1-12 illustrate steps 3 and 4 of the process improvement of this invention.

EXAMPLE 1

A 1500 ml plating solution containing 32.0 g $Cd^{++}$/0.4 g polyethylene glycol (PEG) equal parts number average molecular weight (MW) 1000/1450/per liter with a $CN^-/Cd^{++}$ mole ratio of 8 at pH 12.5 was circulated at one foot/second and 30° C. through the cell depicted in FIG. 3 at a current density (CD) of 0.0084 amp/cm$^2$ for 300 minutes. The 20.4 g Cd deposited on the 230 cm$^2$ cathode represents a 100% cathode current efficiency and had an average 3.5±0.1 mil plate thickness with centerline averages (CLA's) of 18–19 microinches and the 0.22 moles $CN^-$/F shows the amount of $CN^-$ that is lost in the absence of hydrazine.

EXAMPLE 2

A 1500 ml plating solution containing 68.5 g $Cd^{++}$/0.31 moles $H_2NNH_2$/0.4 g PEGs (equal parts MW 1000 and 1450)/per liter with a $CN^-/CD^{++}$ mole ratio=4 at pH=12.30 was circulated at one foot/-second and 30° C. through the cell at a CD=0.008 amp/cm$^2$ for 300 minutes. The 34.7 g Cd deposited on the 416 cm$^2$ cathode area represents a 100% cathode current efficiency and had a 3.72±0.18 mil average plate thickness with CLA's of 40–58. The plating solution increased by 4 ppm Fe and the current efficiency for anodically oxidizing $H_2NNH_2$ was 97%.

EXAMPLE 3

A 1500 ml plating solution containing 67.8 g $Cd^{++}$/0.4 g PEG 9 equal parts MW 1000 and 1450)/0.30 moles $H_2NNH_2$/per liter with a $CN^-/Cd^{++}$ mole ratio=4 at pH=12.63 was circulated at one foot/second and 30° C. through the cell at a CD (Current Density)=0.01 amp/cm$^2$ for 240 minutes. The 36.6 g Cd deposited on the 416 cm$^2$ cathode area represents a 100% cathode current efficiency and had a 3.89±0.11 mil average plate thickness with CLA's of 60–91. The current efficiency for anodically oxidizing $H_2NNH_2$ was 95.6% and the plating solution increased by 3 ppm Fe. This cathode was run over 192 hours in an electrolysis cell and its cathode gave normal ADN yields and showed no signs of fouling.

EXAMPLE 4

A 1500 ml plating solution containing 67.4 g $Cd^{++}$/0.4 g PEG (equal parts MW 1000 and 1450)/0.30 moles $H_2NNH_2$/per liter with a $CN^-/Cd^{++}$ mole ratio=4 at pH=11.80 was circulated at one foot/second and 50° C. through the cell at a CD=0.01 amp/cm$^2$ for 240 minutes. The 36.7 g Cd deposited on the 416 cm$^2$ cathode represents a 101% cathode current efficiency and had a 3.92±0.12 mil plating thickness with CLA's of 26–42. The current efficiency for anodically oxidizing $H_2NNH_2$ was 101% and the plating solution increased by 3 ppm Fe.

EXAMPLE 5

A 1500 ml plating solution containing 64.1 g $Cd^{++}$/0.4 g PEG (equal parts MW 1000 and 1450)/0.31 moles $H_2NNH_2$/per liter with a $CN^-/Cd^{++}$ mole ratio=8 at pH=11.79 was circulated at one foot/second and 30° C. through the cell at CD=0.01 amp/cm$^2$ for 242 minutes. The 36.8 g Cd deposited on the 416 cm$^2$ cathode area represents a 101% cathode current efficiency and had a 3.81±0.19 mil average plate thickness with CLA's of 9–18. The plating solution increased by 4 ppm Fe and the current efficiency for anodically oxidizing $H_2NNH_2$ was 97.5%. An average of 0.007 moles $CN^-$/Faraday was lost in this series of plating fourteen cathodes which shows that less $CN^-$ is lost in the presence of hydrazine. No HCN was detected in the offgas.

EXAMPLE 6

A 1500 ml plating solution containing 45.7 g $Cd^{++}$/0.4 g PEG (equal parts MW 1000 and 1450)/3600 ppm $Fe^{+++}$ (added as $K_3Fe(CN)_6$)/per liter with $CN^-/Cd^{++}$ mole ratio=8 at pH=12.67 was circulated at one foot/second and 30° C. through the cell at a CD=0.008 amp/cm$^2$ for 300 minutes. The 34.5 g Cd deposited on the 416 cm$^2$ cathode area represents a 94% cathode current efficiency and had 3.75±0.15 mil plating thickness with CLA's of 6–9. A sample of the cadmium plating (3.75 mils thick) was dissolved in nitric acid and less than 40 ppm Fe was found in the plate. The cathode was run over 268 hours in an electrolysis cell producing good ADN yields and showed no signs of fouling which shows that a satisfactory cadmium cathode can be plated in the presence of high $Fe^{+++}$ concentrations.

EXAMPLE 7

A 1500 ml plating solution containing 47.5 g $Cd^{++}$/0.4 g PEG (equal parts MW 1000 and 1450)/per liter with ethylenediaminetetraacetate (EDTA)/$Cd^{++}$ mole ratio=1.5 at pH 8.1 was circulated at one foot/-second and 30° C. through the ce-1 at a CD=0.008 am/cm$^2$ for 300 minutes. The 12.5 g Cd on the 230 cm$^2$ cathode area represents a 65% cathode current efficiency and had 2.64±0.06 mil plating thickness with a CLA of 14. The iron content of the plating solution increased 22 ppm and 0.148 moles EDTA/faraday was lost during electrolysis which shows the amount of EDTA lost in the absence of hydrazine.

EXAMPLE 8

A 1500 ml plating solution containing 67.4 g $Cd^{++}$/no leveling agent and no $H_2NNH_2$ added/per liter with a EDTA/$Cd^{++}$ mole ratio=1.67 at pH=12.8 was circulated at one foot/second and 30° C. through the cell at a Cd=0.008 amp/cm$^2$ for 300 minutes. The 35.1 g Cd on the 416 cm$^2$ cathode area represents a 101.4% cathode current efficiency but the surface was heavily ridged. The iron content of the plating solution increased by 1 ppm and 0.14 moles EDTA/-faraday was lost during electrolysis which shows the amount of EDTA lost in the absence of hydrazine, and shows how rough the surface becomes without a leveling agent being present.

EXAMPLE 9

A 1500 ml plating solution containing 60.0 g $Cd^{++}$/2.0 g $C_{16}TMAOH$/0.30 moles $H_2NNH_2$/per liter with a EDTA/$Cd^{++}$ mole ratio=1.12 at pH=12.50 was circulated at one foot/second and 30° C. through the cell at a CD=0.008 amp/cm$^2$ for 300 minutes. The 34.5 g Cd on the 416 cm$^2$ cathode area represents a 99.7% cathode current efficiency and had 4.10+0.20 mil plating thickness with CLA's of 40–43. The iron content of the plating solution increased 1 ppm and the 0.03 moles EDTA/faraday lost during electrolysis shows that smaller amounts of EDTA are lost in the presence of hydrazine.

EXAMPLE 10

A 1500 ml plating solution containing 30.3 g $Cd^{++}$/0.2 g $C_{16}TMAOH$/0.30 moles $H_2NNH_2$/per liter with a EDTA/$Cd^{++}$ mole ratio=1.5 was circulated at one foot/second and 30° C. through the cell at CD=0.008 amp/cm$^2$ for 261 minutes. The 30.3 g Cd deposited on the 416 $cm^2$ cathode area represents a 100.0% cathode current efficiency and had a 3.32 mil plating thickness with CLA's of 86 to 115. The iron content of the plating solution increased by 1 ppm; the current efficiency for anodically oxidizing $H_2NNH_2$ was 100.0% and the 0.011 moles EDTA/faraday lost during electrolysis shows that smaller amount of EDTA are lost when hydrazine is present.

EXAMPLE 11

A 1500 ml plating solution containing 60.0 g $Cd^{++}$/1.0 g PEG's (equal parts MW 1000 and 1450)/0.45 moles $H_2NNH_2$/per liter with an EDTA/Cd-mole ratio=2.1 at pH=11.7 was circulated at two feet/second and 40° C. through the cell at a CD=0.012 amp/$cm^2$ for 104 minutes. The 18.6 g Cd on the 416 $cm^2$ cathode area represents a 102% cathode current efficiency which characterizes the high efficiency to be expected when using solution of pH≧11.7. The 1.92±0.08 mil plating thickness had CLA's of 12–19 microinches.

EXAMPLE 12

A 1500 ml plating solution containing 40 g $Cd^{++}$/1.0 g PEG's (equal parts MW 1000 and 1450)/0.45 moles $H_2NNH_2$/per liter with an EDTA/$Cd^{++}$ mole ratio=2.1 at pH 11.0 was circulated at one foot/second and 40° C. through the cell at a CD=0.016 amp/$cm^2$ for 78.5 minutes. The 14.0 g Cd on the 416 $cm^2$ cathode area represents only a 76.5% cathode current efficiency which shows how the current efficiency can be decreased by operating with a solution of pH less than 11.7. The 1.75±0.10 mil plating thickness had CLA's of 59–96 microinches which reflects the roughing of the surface as the current density is increased.

In-place plating of multi-electrode cell packages comprising "bi-electrodes" (having a carbon steel side as the anode for one-cell and a plated side which is the cathode for the adjacent cell and having no independent source of electrical potentail as by independent electrical current) may be accomplished in the same manner as depicted in the drawing, and explained herein. It should be pointed out however that a variance will inevitability occur in the plating thickness between the plated cathode surfaces of interior bypolar and exterior plates of the package. Such variances are believed to be consistent with good performance and long life in subsequent electrochemical synthesis where the commercial packages contain as many as 200 plates.

EXAMPLE 13

An electrolytic cell having a carbon steel anode separated by a gap of 2.72 milliliters from a cadmium plated cathode contains an aqueous solution having dissolved therein approximately 1.6% acrylonitrile, 1.2% adiponitrile, 0.2% acrylonitrile (electrohydrodimerization byproducts), $5.8\times10^{-3}$ gram mol per liter of ethyltributylammonium cations, 10% of a mixture of incompletely-substituted sodium orthophosphates corresponding to the solution pH of 9 (approximately $Na_{1.9}H_{1.1}PO_4$), 0.1% of a ferrous metal corrosion inhibitor (tetrasodium pyrophosphate) and 0.05% of tetrasodium ethylenediamine-tetraacetate. Also entrained in the solution is approximately 1% by weight of an organic phase containing about 54% adiponitrile, 29% acrylonitrile, 9% acrylonitrile dimerization byproducts and 8% water. The solution is circulated at 55° C. and a velocity of 1.22–1.37 meters per second through the undivided electrolytic cell. The aqueous solution is electrolyzed as it passes through the cell with a voltage drop across the cell at 4.7 volts and a current density of 0.27 amp per square centimeter of cathode surface and then fed into a decanter for equilibration with an accumulated upper layer having approximately the composition of the described organic phase, and withdrawal of equilibrated lower (aqueous) layer for recycle through the cell. After 776 hours of electrolysis, during which time acrylonitrile and water are continuously added to the circulating aqueous solution and an equivalent amount of product is removed from the decanter upper layer, the cell is drained of all dimerization electrolyte, and refilled and flushed with the plating solution described in Example 1. The plating solution is thereafter drained; and fresh plating solution is introduced into the cell. An electrical potential is introduced across the cell as described in Example 1. After 300 minutes, the electrical potential is discontinued, and the plating solution is left standing in the cell for a period of five minutes, and thereafter drained. The dimerization electrolyte solution is reintroduced into the cell and the electrolytic dimerization process is continued.

We claim:

1. In a process for the production of adiponitrile from acrylonitrile by electrolytic dimerization in an electrolytic cell containing a dimerization electrolyte and electrodes comprising anodes and cathodes, at least a portion of which cathodes are metal plated, and which cathodes, after prolonged exposure to the dimerization electrolyte during the electrolytic dimerization process, require occasional cleaning and electroplating, the improvement comprising (1) draining the cell of the dimerization electrolyte, (2) cleaning the electrodes, (3) replacing the dimerization electrolyte with an electroplating solution containing the plating metal in complex form, (4) applying an electric potential between the anodes and the cathodes whereby the cathodes are electroplated and the anodes function as non-sacrificial anodes, (5) thereafter discontinuing the electric potential without draining the cell thereby permitting the newly electroplated cathodes exposure to the plating solution in the absence of electrical potential for a definable exposure period, (6) thereafter draining the electrolytic cell of electroplating solution, (7) filling the cell with the dimerization electrolyte, and (8) continuing the electrolytic dimerization process.

2. The process of claim 1 wherein cleaning the electrodes comprises flushing the cell with a phosphoric acid cleaning solution and rinsing with water.

3. The process of claim 1 wherein cleaning the electrodes comprises flushing the electrodes with the electroplating solution.

4. The process improvement of claim 1 wherein the cathodes are cadmium-plated steel.

5. The process improvement of claim 1 wherein the anode is carbon steel.

6. The process improvement of claim 1 wherein the cathode is cadmium-plated carbon steel and the anode is unplated carbon steel.

7. The process improvement of claim 1 wherein the electrolyte in the electroplating step includes a polyether surfactant.

8. The process improvement of claim 1 wherein the electrolyte in the electroplating step includes hydrazine.

9. The process improvement of claim 1 wherein the electrolyte in the electroplating step includes a polyether surfactant and hydrazine.

10. The process improvement of claim 1 wherein the electrolyte in the electroplating step includes a complexing agent selected from the group consisting of cyanide and ethylenediaminetetraacetate, a polyether surfactant and hydrazine.

11. The process improvement of claim 1 wherein interior electrodes are by-polar plates comprising a cathode surface and an anode surface.

12. The process improvement of claim 1 wherein the cathode surface is cadmium and the anode surface is carbon steel.

13. The process improvement of claim 1 wherein the definable exposure period is 1–10 minutes.

* * * * *